United States Patent [19]

Pelto-Huikko

[11] Patent Number: 5,046,586

[45] Date of Patent: Sep. 10, 1991

[54] CONTROL VALVE FOR A HYDRAULIC ELEVATOR

[75] Inventor: Raimo Pelto-Huikko, Vantaa, Finland

[73] Assignee: Kone Elevator GmbH, Baar, Switzerland

[21] Appl. No.: 629,793

[22] Filed: Dec. 19, 1990

[30] Foreign Application Priority Data

Dec. 19, 1989 [FI] Finland ..... 896103

[51] Int. Cl.[5] ..... B66B 9/04

[52] U.S. Cl. ..... 187/17; 60/329; 187/29.2

[58] Field of Search ..... 60/329; 187/17, 29.2, 187/68, 110, 111

[56] References Cited

U.S. PATENT DOCUMENTS 3,530,958 9/1970 Brannon et al. ..... 187/17
4,426,194 1/1984 Pollman ..... 60/329 X
4,955,194 9/1990 Christensen et al. ..... 60/329

FOREIGN PATENT DOCUMENTS 3001770 7/1981 Fed. Rep. of Germany .
1-242373 9/1989 Japan .

*Primary Examiner*—Joseph E. Valenza
*Assistant Examiner*—Dean A. Reichard
*Attorney, Agent, or Firm*—Sughrue, Mion, Zinn, Macpeak and Seas

[57] ABSTRACT

Control valve for a hydraulic elevator provided with a speed regulating plug which moves in response to the flow of hydraulic fluid, whereby the position of the speed regulating plug determines the rate of flow of hydraulic fluid into the actuating cylinder of the elevator, and a hydraulic channel system forming an essentially closed loop. The invention achieves a constant rate of deceleration of the elevator regardless of variations in the temperature of the hydraulic fluid by providing the hydraulic channel system with a flow resistance component placed near one end of the speed regulating plug, the setting of the flow resistance component being varied in response to variations in the temperature of the hydraulic fluid.

7 Claims, 2 Drawing Sheets

CONTROL VALVE FOR A HYDRAULIC ELEVATOR

FIELD OF THE INVENTION

The present invention relates to control valves for hydraulic elevators.

BRIEF DESCRIPTION OF THE PRIOR ART

A conventional hydraulic elevator control valve is provided with a main hydraulic channel through which the main flow of hydraulic fluid passes; a movable speed regulating plug disposed in the flow of hydraulic fluid; and a system of secondary hydraulic channels connected to each end of the speed regulating plug, which communicate with the main hydraulic channel such that, when the control valve is closing, one flow component of hydraulic fluid flows out of the space at one end of the speed regulating plug, and a second flow component flows into the space at the other end of the speed regulating plug through a throttle. The speed regulating plug thus moves with the flow of hydraulic fluid in the secondary hydraulic channels, and the position of the speed regulating plug determines the rate of flow of the hydraulic fluid into the actuating cylinder of the elevator, thereby controlling the speed of the elevator.

The viscosity of oil, which is the hydraulic fluid most commonly used in hydraulic elevators, is reduced by about a decade as the oil is heated from the lowest working temperature to the highest working temperature. In the case of an elevator provided with a pressure-controlled ON-OFF-type control valve, this has the effect of producing an increase in deceleration with an increase in temperature, because the reduced kinetic resistance to movement of the valve plug, offered by the oil, allows the control valve to close faster.

In principle, deceleration of the elevator is based on a hydromechanical time reference. After the supply of electricity to the magnetic valve has been interrupted, a spring pushes the speed regulating plug of the control valve towards the closed position, while a throttle in the secondary hydraulic circuit supplying the speed regulating plug retards the closing of the valve. It is important to notice that the closing speed depends on the viscosity of the oil even in the case of a fully viscosity-independent throttle, because the kinetic resistance to movement of the speed regulating plug depends on the oil viscosity. As the kinetic resistance diminishes in response to reduced viscosity, the pressure difference across the throttle increases, producing an increase in the rate of flow in the secondary channel, towards the speed regulating plug, and therefore an increase in the plug speed.

A problem in this case is that the elevator, when working at "normal operating temperature", has an excessively long creeping time when arriving at a landing. This is because the distance at which the deceleration vanes in the hoistway are spaced from the landing must be adjusted for the lowest oil temperature to avoid overtravel.

German patent application publication DE 2908020 proposes a device for decelerating a hydraulic elevator by means of throttles and valves controlling the open position of a by-pass valve. The adjustment depends on the temperature of the hydraulic fluid. However, the device has the disadvantage that it uses a magnetic valve, necessitating a connection to the electrical system, thus rendering the solution too complex.

SUMMARY OF THE INVENTION

One of the main objects of the present invention is to create a control valve for a hydraulic elevator which achieves compensation for variations in the viscosity of the hydraulic fluid, in a simple manner, so as to maintain the creeping distance essentially constant throughout the range of operating temperatures of the oil.

The control valve of the invention is characterized in that the secondary hydraulic channel system is provided with a flow resistance component placed near either end of the speed regulating plug. The setting of said flow resistance component being varied on the basis of the temperature of the hydraulic fluid.

The invention has the advantage that it provides a control valve for hydraulic elevators that is independent of variations in the viscosity of the oil, thus ensuring a reliable deceleration of the elevator and making it more comfortable for the passengers at a low cost.

BRIEF DESCRIPTION OF THE DRAWINGS

A preferred embodiment of the invention will now be described, with reference to the appended drawings, wherein.

DESCRIPTION OF THE PREFERRED EMBODIMENTS

Figure 1:
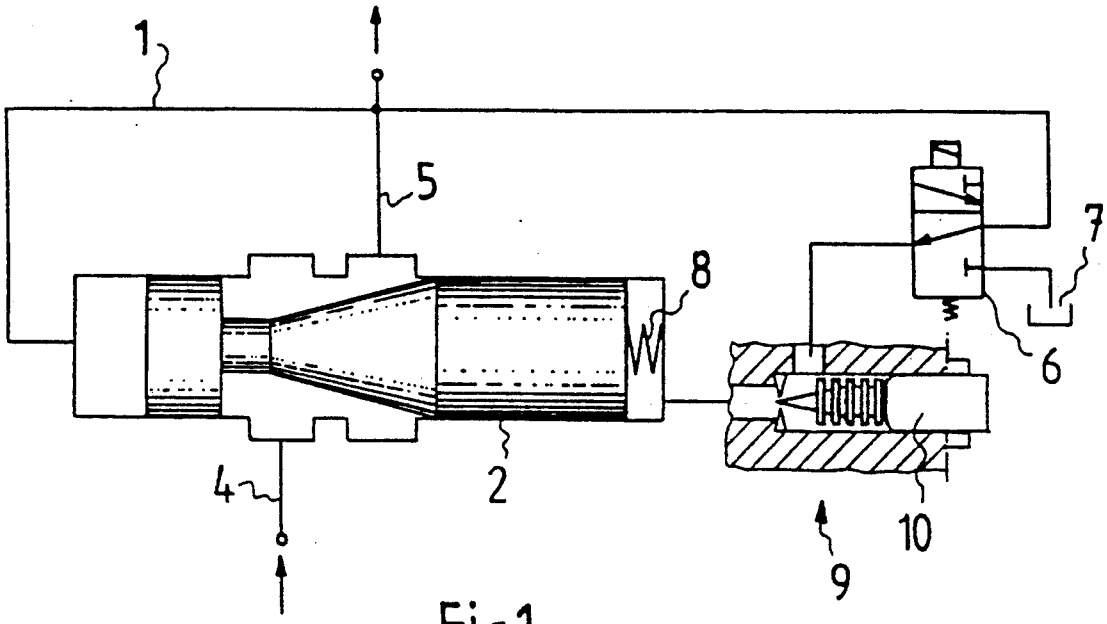
FIG. 1 diagrammatically shows a part of a hydraulic control valve wherein a channel system is provided. with a flow resistance component as provided by the invention.

FIG. 1 shows part of the hydraulic channel system 1 of a conventional control valve of a hydraulic elevator. A speed regulating plug 2 moves in an essentially closed space 3 provided for it. The hydraulic fluid in the main flow channel flows from the inflow channel 4, through the space 3 enclosing the speed regulating plug 2, to the outflow channel 5 which leads to the actuating cylinder of the elevator. The middle part of the speed regulating plug is of an essentially conical form, as shown in FIG. 1. Thus, when the plug moves longitudinally to the left (as seen in FIG. 1), it throttles the flow of hydraulic fluid in the main flow channel 4, 5. The rate of flow is greatest when the plug is in its extreme right position. When the distributing valve 6 is in the position shown in FIG. 1, the spring 8 pushes the speed regulating plug 2 towards the closed position, i.e. to the left in FIG. 1, causing the elevator to decelerate. As a result of this closing movement of the speed regulating plug 2, the oil used as hydraulic fluid will pass from the left-hand end of the speed regulating plug 2 and flow in the hydraulic channel system 1 through the distributing valve 6 and the flow resistance component 9 into the spring space to the right of the speed regulating plug 2. The flow resistance component 9 presents a resistance to this flow, thus determining the speed of movement of the speed regulating plug 2.

Notice that in the position shown in FIG. 1, the 3/2-way distributing valve 6 provided in the hydraulic channel system 1 permits a fluid flow towards the righthand end of speed regulating plug 2. In this situation, the speed regulating plug 2 is moving to the left, throttling the flow in the main flow channel 4-5, and the elevator is being decelerated. In the other position of the distributing valve 6, the hydraulic fluid is allowed to flow into the tank 7, and fluid pressure on the left-hand end of the speed regulating plug 2 moves the speed regulating plug 2 to the right until it has reached its fully open position and the elevator is travelling at full speed.

As the temperature of the hydraulic fluid rises during use, its viscosity is reduced, thus reducing the kinetic resistance of the hydraulic fluid to movement of the speed regulating plug 2. Consequently, the speed regulating plug of the control valve is closed faster, resulting in a greater rate of deceleration of the elevator. The change in the flow through the hydraulic channel 1, between the operating temperature extremes, is about 30%, and the variation in deceleration in previously known control valves is proportional to this. This variation in deceleration is one of the drawbacks of previously known control valves.

The forgoing discussion may equally apply to conventional hydraulic control valves with the provision that the above mentioned flow resistance component 9 is comprised of a fixed throttle, whereas in the control valve of the invention, the flow resistance component 9 is responsive to variations in the temperature of the hydraulic fluid. The features and method of operation of the flow resistance component 9 will now be described in detail.

Figure 2:
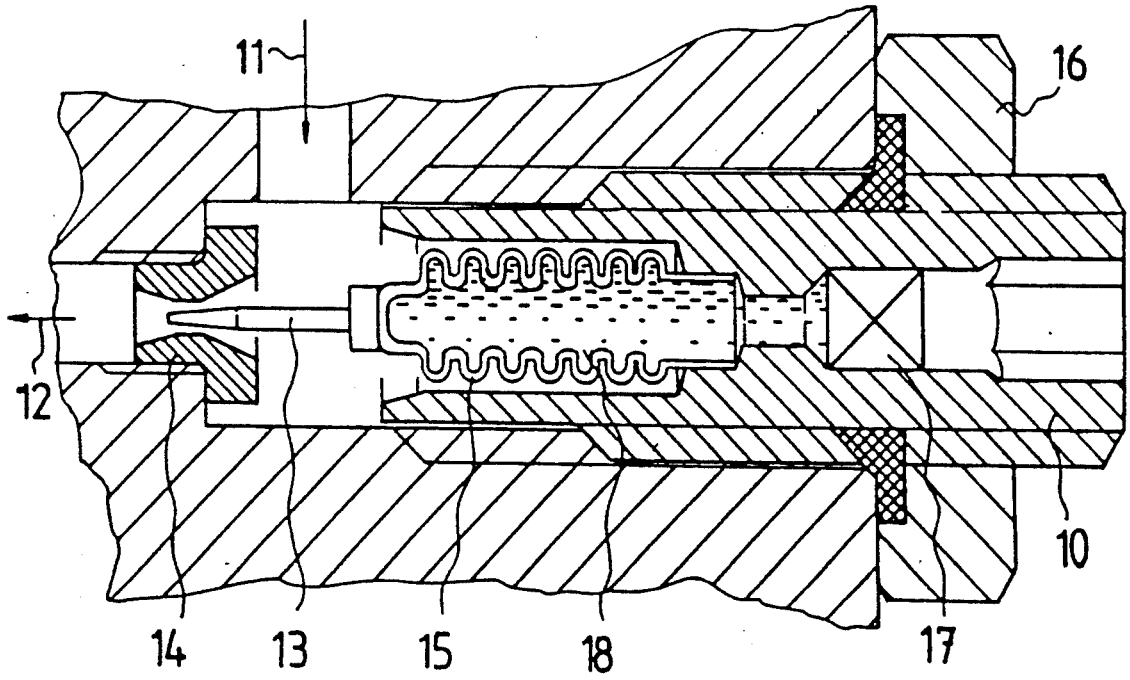
FIG. 2 shows a sectioned view of one embodiment of the flow resistance component of the invention.

As illustrated by the embodiment of the control valve of the invention shown in FIG. 1, the hydraulic channel system 1 is provided with a flow resistance component 9, disposed between the distributing valve 6 and the speed regulating plug 2, which is responsive to the temperature of the hydraulic fluid. Inside the body of the flow resistance component 9 is a needle valve having a body 10 made of brass or other suitable metal. FIG. 2 shows a more detailed view of one embodiment of the needle valve. The hydraulic fluid flows into the needle valve as inflow 11 and out of the valve as outflow 12, which goes to the speed regulating plug 2. The flow is throttled between the conical point of the needle 13 and the choke piece 14. The mouth of the choke piece 14, is also of a conical form. Behind the conical mouth of the choke piece 14, there is the narrowest part of the choke piece 14, the diameter of which essentially corresponds to the largest diameter of the needle 13. The range of motion of the needle 13 is approximately 1 mm in the axial direction, and the flow through the choke piece 14 is throttled accordingly.

The needle movement is produced by means of a regulator consisting of a hollow bellows 15, constructed of brass or other suitable metal, housed in a bore provided in the body 10 of the valve. The hollow inside the bellows 15 is filled with a liquid 18, for example spirit or other alcohol. The liquid 18 reacts to variations in the temperature of the hydraulic fluid by expanding or contracting, thereby causing the needle 13 of the needle valve to move accordingly. The body 10 of the needle valve is fastened to the body of the flow resistance component 9 by means of a sealing nut 16, and the liquid 18 in the bellows 15 is retained in the bellows 15 by a stopper 17.

The flow resistance component 9, controlled by the temperature of the hydraulic fluid, is used in the deceleration of a hydraulic elevator to compensate for the variations in the rate of deceleration of the elevator resulting from changes in the viscosity of the hydraulic fluid (due to changes in temperature). The compensation works as follows. As the temperature of the hydraulic fluid 11 flowing into the flow resistance component 9 rises during use (and its viscosity decreases), the bellows 15 and the liquid 18 inside it are heated. As the liquid 18 gets warmer, it expands and extends the bellows 15. As a consequence of this extension of the bellows 15, the needle 13 is moved towards the choke piece 14. As a result of the conical shape of both the needle 13, and the inner surface choke piece 14, the flow of the hydraulic fluid is choked. By suitably determining the taper of each of the respective conical surfaces of the needle 13 and choke piece 14, the rate of flow of hydraulic fluid through the flow resistance component 9, and thus the closing speed of the speed regulating plug 2, can be maintained essentially constant throughout the range of operating temperatures of the hydraulic fluid.

Figure 3:
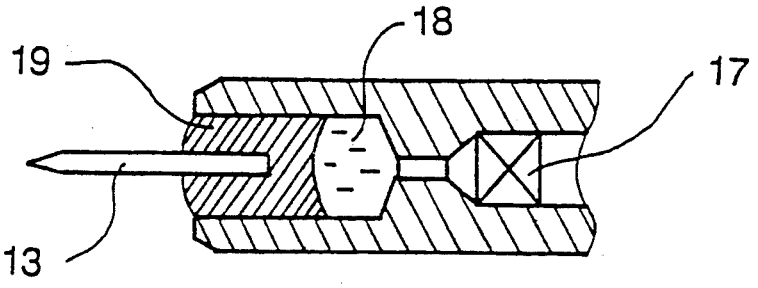
FIG. 3 illustrates another embodiment of part of the flow resistance component of the invention.
Figure 4:
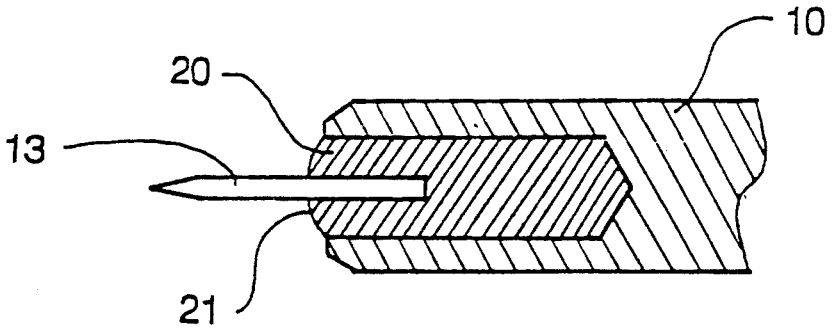
FIGS. 4 illustrates yet another embodiment of part of the flow resistance component of the invention.

It should be obvious to a person skilled in the art that the brass bellows 15 of the flow resistance component 9, described in the above illustrative embodiment, can be replaced with other suitable solutions. FIG. 3 illustrates an alternative embodiment in which the brass bellows 15 with a liquid filling 18 has been replaced by an elastomeric bellows 19 which is in contact with the liquid 18. Furthermore, FIG. 4 shows yet another embodiment in which an elastomeric bellows 20 has no liquid space at all inside it. Instead, the material reacting to temperature consists of an elastomer alone. For example, a suitable silicone can be used for this purpose. The spherical surface 21 of the elastomeric bellows 19, 20 facilitates a large needle motion with changes in temperature.

It will be obvious to a person skilled in the art that the invention is not restricted to the examples of its embodiments described above, but that it may instead be varied within the scope of the following claims.

I claim:

1. A control valve for a hydraulic elevator comprising:

(a) a main hydraulic channel, through which the main flow of the hydraulic fluid passes;

(b) a speed regulating plug, disposed in said main channel and responsive to the flow of hydraulic fluid, the position of said speed regulating plug determining the flow of hydraulic fluid into the actuating cylinder of the elevator;

(c) a system of hydraulic channels, connected to each end of said speed regulating plug and communicating with said main hydraulic circuit, such that when said speed regulating plug is closing, one component of hydraulic fluid flow passes out of the space at one end of said speed regulating plug, and a second flow component of hydraulic fluid flows into the space at the other end of said speed regulating plug; and (d) A flow resistance component disposed in said system of hydraulic channels near either end of said speed regulating plug; the setting of said flow resistance component being varied on the basis of the temperature of the hydraulic fluid such that the rate of flow through said flow resistance component is maintained essentially constant throughout the operating range of temperatures of the hydraulic fluid.

2. A control valve according to claim 1, wherein said flow resistance component comprises a needle valve comprising a body, a choke piece comprising a hole through which the fluid flows, and a needle connected to an adjusting element in such manner that when the temperature rises, the needle approaches the choke piece reducing the flow, and conversely, when the temperature falls, the needle moves farther away from the choke piece increasing the flow.

3. A control valve according to claim 2, wherein said adjusting element comprises a hollow metal bellows, filled with a liquid responsive to temperature changes.

4. A control valve according to claim 2, wherein said adjusting element comprises an elastomeric bellows forming a hollow space in said body, said hollow space being filled with a liquid responsive to temperature changes.

5. A control valve according to claim 2, wherein said adjusting element is composed of an elastomeric material responsive to temperature changes.

6. A control valve according to claim 5, wherein said adjusting element comprises a spherical surface on the side facing the choke piece, said surface being provided with a needle so fitted that it will move towards the choke piece and away from it as said spherical surface moves.

7. A control valve for a hydraulic elevator according to claim 2, wherein:

said needle of said needle valve has a conical end which is disposed so as to move within a range of about 1 mm inside said choke piece, said hole of said choke piece being adapted for this purpose; and the characteristic of deceleration of the elevator is varied by varying the angle of taper of said conical end of said needle.

* * * * *